United States Patent [19]

Schmidt et al.

[11] 4,058,089

[45] Nov. 15, 1977

[54] ELECTRICALLY CONTROLLED FUEL INJECTION SYSTEM

[75] Inventors: Peter Schmidt; Helmut Worz, both of Schwieberdingen, Germany

[73] Assignee: Robert Bosch GmbH, Stuttgart, Germany

[21] Appl. No.: 614,769

[22] Filed: Sept. 18, 1975

[30] Foreign Application Priority Data

Oct. 10, 1974 Germany ..... 2448304

[51] Int. Cl.[2] ..... F02B 3/00

[52] U.S. Cl. ..... 123/32 ED; 123/32 EB

[58] Field of Search ..... 123/32 EA, 32 AE, 32 ED, 123/32 EB, 32 EJ

[56] References Cited

U.S. PATENT DOCUMENTS

| | | | |
|---|---|---|---|
| 2,372,766 | 4/1945 | Colvin et al. | 123/32 AE |
| 2,941,524 | 6/1960 | Aldinger et al. | 123/32 EA |
| 2,943,614 | 7/1960 | Bosch et al. | 123/32 EA |
| 3,747,577 | 7/1973 | Mauch et al. | 123/32 EA |
| 3,750,631 | 8/1973 | Scholl et al. | 123/32 EA |
| 3,796,199 | 3/1974 | Knapp | 123/32 EA |
| 3,824,966 | 7/1974 | Schneider et al. | 123/32 EA |

*Primary Examiner*—Ronald B. Cox
*Attorney, Agent, or Firm*—Edwin E. Greigg

[57] ABSTRACT

A fuel injection system for an internal combustion engine includes an electronic fuel controller which accepts signals representative of the air flow rate through the engine's induction tube as well as data relating to rpm and other parameters. The air flow rate data is derived from an electrically heated wire, located in the induction tube, which is connected in one branch of a bridge circuit. Changes in the air flow rate result in changes of heat transfer and hence of the temperature of the heated wire whose impedence changes accordingly. A control loop senses the imbalance of the currents in the two branches and acts to restore equilibrium, e.g. by increasing the total bridge current until a higher heat loss from the wire has been compensated. The increased bridge current is provided by periodic current pulses delivered by transistors under the control of a multivibrator. The multivibrator is triggered at a frequency which is a function of the imbalance signal voltage.

9 Claims, 4 Drawing Figures

ELECTRICALLY CONTROLLED FUEL INJECTION SYSTEM

BACKGROUND OF THE INVENTION

The invention relates to an electrically controlled and preferably intermittently operating fuel injection system for internal combustion engines. The fuel injection system includes and electronic controller which determines the injected fuel quantity per unit time or per power stroke of the internal combustion engine and cooperates with an air flow rate meter which has a temperature-dependent resistor located in the induction tube of the engine. The resistor is located in one branch of a bridge circuit in a closed control loop and the heating current has a first DC component large enough to balance the bridge when the air flow rate Z is zero and an adjustable, superimposed second component. The second component has the value zero when Q is zero and can be increased with increasing air flow rate so as to compensate for the heat lost by the temperature-dependent resistor to the flowing induction air.

Known fuel injection systems include several injection valves, each valve associated with one cylinder of the internal combustion engine, wherein the temperature-dependent resistor located in the induction tube of the engine is heated by means of a heating coil, which transmits a constant amount of heat to the resistor either by radiation or convection. A resistor heated in this manner is subject to increased cooling when the aspirated air quantity increases and its electrical conductivity changes considerably. This change, which is a function of the aspirated air quantity, is used in the known system to control the opening duration of the one or several injection valves by making the resistor a part of a measuring bridge, the voltage across the diagonal branch of the bridge circuit increasing with increasing air flow. The diagonal voltage is used in the known system to control the time constant of a multivibrator which includes two mutually blocking transistors and the time constant of the multivibrator, in turn, determines the opening time of the valves.

When the temperature-dependent resistor is heated by a separate housing resistor, any changes in the heater supply voltage affect the precision of the air-flow measurement. Substantially higher precision may be achieved by heating the temperature-dependent resistor by an internal current and by adjusting the magnitude of this heating current via an electronic controller so that the operational temperature of the resistor remains practically constant. In that case, the magnitude of the heating current provides a reliable and precise source of information as to the time average of the aspirated air quantity.

The above described principle of hot-wire air-flow measurement is particularly suitable for fuel injection systems, because this constant temperature method permits the controlled heating current to follow the changes in the air flow rate within a response time of approximately 10 milliseconds or less. In the described process, the temperature-dependent resistor is one of the four elements in a resistance bridge in which the other three resistors are substantially temperature-independent and are located outside of the air flow. The two end-points of one of the diagonals of the bridge circuit are connected to the input of the controller and the controller delivers to the opposite bridge diagonal a heating current which changes with the aspirated air quantity. However, when using this process, two difficulties arise: When the internal combustion engine is stopped, the bridge must be balanced and the initial heating current must be such as to provide the necessary operating temperature for the temperature-dependent resistor. When the air through-put is maximum, i.e. during full load and maximum rpm operation of the engine, the heating current must be increased to two or three times its initial value. However, for control purposes, the interesting part of the information lies in the current increase and not in its initial value and the initial value should therefore be suppressed by subtraction. This results in a relatively low precision of the available information. The second difficulty resides in that the heating power $N_H$ from the resistor as a function of the time average of the aspirated air quantity Q obeys the relation $$N_H \alpha [Q]^{\frac{1}{2}}$$

When the bridge equilibrium is established by changing the voltage across the opposite diagonal branch, the balancing signal is usually the voltage across the bridge resistor lying in series with the temperature-dependent resistor. Thus, the relation between the balancing voltage $U_S$ and the air throughput obeys the relation $$U_S \alpha [Q]^{\frac{1}{2}}$$

This means that the useful signal $U_S$ changes only very little, even during substantial changes of the air throughput. For example, if the air flow rate changes in the ratio 1:35, the balancing voltage changes only by the ratio 1:2.5 which results in a low accuracy during the signal processing and during the adaptation of the injected fuel quantity to the aspirated air quantity.

In order to avoid these difficulties, a known fuel injection system provides that the heating current is composed of a first, steady DC component and a second component whose magnitude changes periodically. The latter component has the value 0 when the air flow rate Q is zero and it is increased with increasing air quantity until it produces enough heat to compensate for the heat lost to the air current.

In this system, the steady DC component is adjusted to the magnitude of the current needed when the air flow rate Q equals zero.

In this known system, the control current consists of heating current pulses, preferably of constant width, whose frequency is automatically adjusted by the controller and which are fed to a fuel control apparatus as air flow rate data.

When using a control process which affects the pulse frequency, it has been shown to be particularly favorable if the pulse duration is approximately 10 microseconds and if the pulse frequency is adjustable from approximately 1 kHz, preferably 2 kHz during idling, up to approximately 20 kHz and preferably up to 12 kHz during full-load and top rpm of the engine. Also provided is a pulse-width modulating system which prolongs the pulse duration with increasing pulse frequency and, for example, delivers pulses whose duration is increased from approximately 10 microseconds when the frequency is 2 kHz at idling, up to approximately 60 microseconds at a pulse frequency of 12 kHz at full-load and/or top rpm.

The available data regarding the aspirated air flow rate is presented in the form of a particular pulse frequency and this frequency must be associated with the opening duration of the injection valves associated with the individual cylinders of the internal combustion engine and hence with the injected fuel quantity to be delivered to the individual cylinders during each power cycle. For this purpose, the known fuel injection system includes an integrating stage whose charging circuit contains a storage capacitor fed by a constant current source which is turned on during the duration of the current pulse. The capacitor is charged in step-wise fashion during a predetermined crank shaft rotation, especially an angle of 180°. The charge stored in the capacitor during a fixed rotational angle can later by transformed into a valve opening pulse by means of a constant current source, especially by a transistor adjusted for constant collector current and the valve opening pulse is adapted to correspond to the air quantity aspirated by an individual cylinder for each engine power cycle. The opening duration of the valves can be changed in a proportion of approximately 1:4 by prolonging the opening pulses in dependence on the input pulse frequency.

OBJECT AND SUMMARY OF THE INVENTION

It is a principal object of the invention to provide a fuel injection system of the known type in which the generation and processing of the pulse frequency signal which corresponds to the aspirated air quantity is performed in digital fashion.

It is another principal object of the invention to maintain the heated sensor wire at substantially constant operating temperature, thereby improving the precision of the control process.

Yet another object of the invention is to provide a control circuit which applies current pulses of varying frequency to the heating wire.

These and other objects are attained according to the invention by connecting two inputs of an operational amplifier to two diagonal points on the bridge circuit containing the heating element while the output voltage from the operational amplifier is transformed into a signal whose frequency is proportional to the aspirated air quantity. This signal serves as the command variable for the magnitude of a secondary heating current applied to the bridge circuit and also serves, after being squared in frequency as the command variable of a digital control system for regulating a fuel quantity proportional to the air quantity.

In an advantageous feature of the invention, the transformation of the output voltage from the operational amplifier into a frequency is performed by a voltage-to-frequency converter. This frequency may be reduced in a fixed proportion by a scaler.

Another advantageous feature of the invention provides that the magnitude of the secondary current is periodically changed, the current consisting of a sequence of heating pulses whose frequency may be changed in dependence on the aspirated air quantity while the pulse width remains constant.

Yet another favorable aspect of the invention provides that the DC component of the heating current may be adjusted by two transistors connected in a Darlington configuration and that the second, periodically changing current component is controlled by a monostable multivibrator triggered by the input frequency.

A second, preferred embodiment of the invention provides that, in the first state of the monostable multivibrator, a current component proportional to a first adjustable voltage is superimposed on the DC heating current via an operational amplifier while, during the second state of the multivibrator, a current component proportional to a second, adjustable voltage is so superimposed.

Another preferred embodiment of the invention provides that the operational amplifier connected to the bridge diagonal is a comparator whose output is connected, via a digital up-down counter, to the input of a digital rate multiplier.

In yet another preferred embodiment of the invention, the heating current of the bridge circuit is an adjustable DC current consisting of an adjustable first DC component, serving for the basic calibration, and an adjustable second DC component for compensating for heat loss of the temperature-dependent resistor to the flowing air. During the first state of the monostable multivibrator, which is triggered by the pulse frequency, a first adjustable voltage is applied to the input of an integrating circuit while, during the second state, a second voltage is so applied. The output voltage of the integrator is amplified and used to control the heating current in the bridge circuit.

The invention will be better understood as well as further objects and advantages thereof will become more apparent from the ensuring detailed specification of four exemplary embodiments taken in conjunction with the drawing.

DESCRIPTION OF THE PREFERRED EMBODIMENTS

Figure 1:
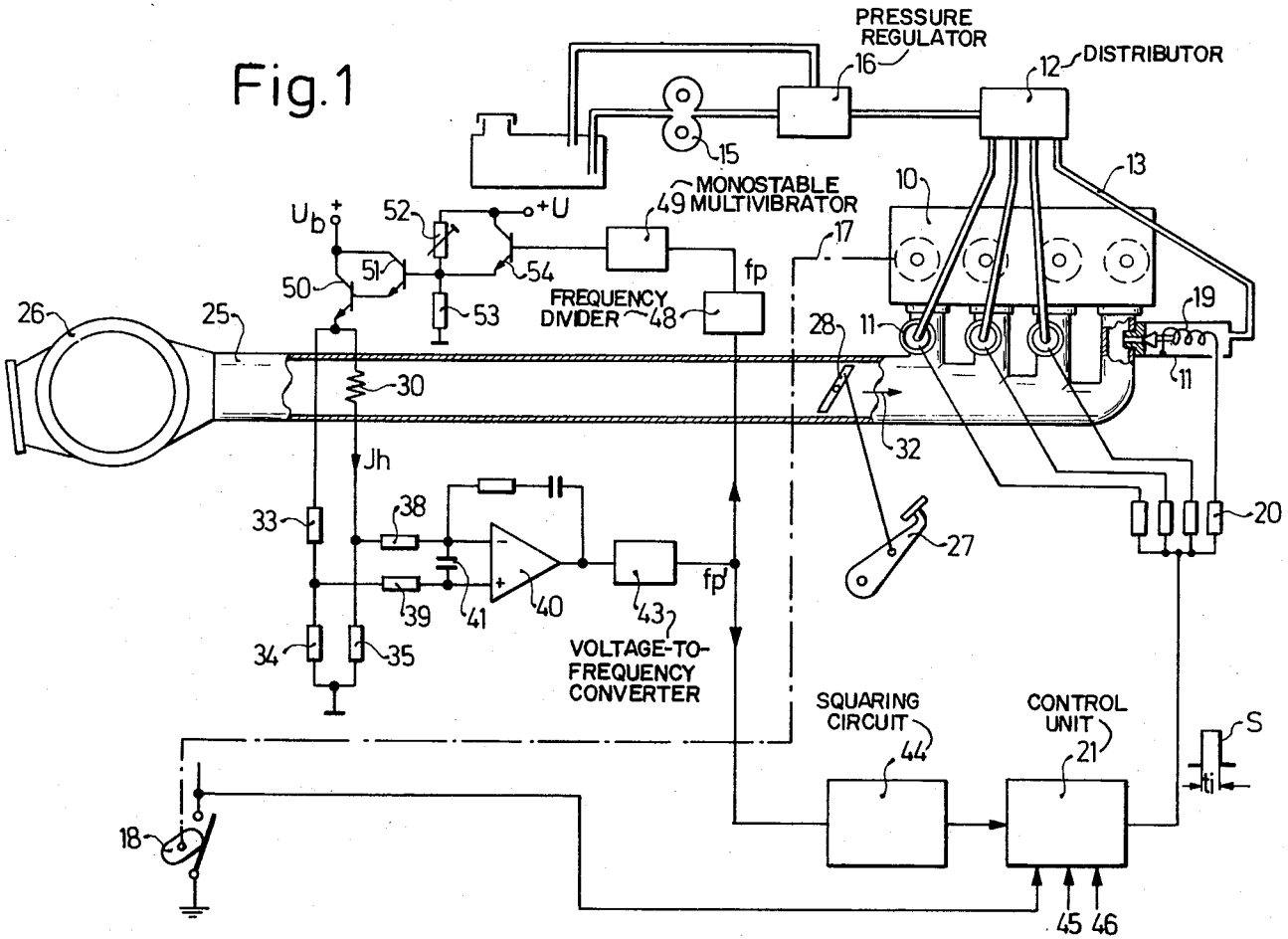
FIG. 1 is an overall schematic diagram of a fuel injection system according to the invention including a schematic block diagram of a first exemplary embodiment of the electronic control system of the invention.

The fuel injection system depicted in FIG. 1 is intended to service a four-cylinder, four-cycle internal combustion engine 10. This fuel injection system includes, as essential constitutents, four electromagnetically actuatable fuel injection valves 11, which are supplied with fuel from a distributor 12 through individual fuel lines 13. The system further includes an electrically driven fuel supply pump 15, a pressure regulator 16 which controls the fuel pressure to a predetermined constant value, and it also includes an electronic control unit which will be described in detail below. This unit is triggered twice during each camshaft revolution by means of a signal generator 18 operatively coupled to the camshaft 17 and thus delivers a rectangular electrical pulse S which is used to control the injection valves 11. The pulse width $t_i$ shown in the drawing determines the opening time of the injection valves and thus also determines the quantity of fuel which is delivered by the injection valves during their opening time, due to an internal constant pressure of approximately 2 bar. Each of the magnetic windings 19 of the injection valves is connected to an individual decoupling resistor 20. All the resistors 20, are in turn, connected to a common amplifying and power stage belonging to a digitally operated electronic control unit 21 which includes at least one power transistor whose emitter-collector path is connected in series with the decoupling resistors 20 and, hence, with the magnetic windings 19, whose other end is grounded. A suitable electronic control unit 21 is described, for example, in U.S. Pat. No. 3,750,631.

In the operation of mixture-compressing and externally ignited internal combustion engines of this type, the fuel quantity provided to a particular cylinder during each piston suction stroke is so chosen that it may be completely combusted during the subsequent power stroke. High engine efficiency requires that no substantial amounts of unused air remain in the cylinder after the power stroke.

In order to obtain the desired stoichiometric relation between the aspirated air quantity and the fuel, a resistor 30 is located in the induction tube 25, downstream of a filter 26, but upstream of the butterfly valve 28 actuated by the gas pedal 27. The resistor 30 is a temperature-dependent resistor through which a heating current $J_h$ is passed. The resistor 30 is made of thin platinum wire having a temperature coefficient of resistivity $\alpha$ of approximately $3.0 \times 10^{-3}$ per °C. The resistor heats up when the current $J_h$ flows through it and its temperature decreases as a function of increasing air flow rate Q through the induction tube 25 in the direction of the arrow 32. In order to eliminate undesirable spurious signals, for example due to voltage changes in the engine battery (not shown), the temperature-dependent resistor 30 is disposed in one of four branches of a bridge circuit whose remaining three resistors 33,34,35 are located outside of the induction tube of the engine. The resistor 33, connected to the temperature-dependent resistor 30, is intended to act as a compensating resistor for the temperature changes of the aspirated air and thus suitably consists of the same material as the resistor 30.

The junction between resistors 33 and 34 and the junction between the temperature-dependent resistor 30 and the resistor 35 are connected, via resistors 38 and 39 respectively, to two inputs of an operational amplifier 40, wired as a PI-controller. A capacitor 41, connected between the two inputs of the amplifier serves for filtering and suppression of spurious signals. The output voltage of the operational amplifier 40 is converted by a voltage-to-frequency converter 43 into a frequency $f_{p'}$ which serves, on the one hand, as a command variable for the magnitude of the second current component fed to the bridge circuit and also serves on the other hand, after being squared by a squaring circuit 44, as the command variable for the digital control system 21 which regulates a fuel injection quantity proportional to the air quantity. The squaring circuit 44 is needed to maintain the linearity between the frequency $f_{p'}$ and the aspirated air quantity Q because these two quantities are related by $$f_{p'} \alpha N_H \alpha [Q]^4$$

The electronic control system 21 has terminals for applying correcting voltages 45,46 by means of which the duration of the opening pulses $t_i$ may be changed multiplicatively in dependence on various operational parameters of the internal combustion engine.

The frequency $f_{p'}$, generated by the voltage-to-frequency converter 43, is chosen to be high enough to permit the digital control system 21 to achieve a high precision and adequate quantization. On the other hand, the pulse frequency $f_p$ which serves to control the heating current of the bridge circuit should not be too high because the transistors in the control circuit have relatively high time constants which would introduce undesirable distortions in the control process. For this reason, the frequency $f_{p'}$, present at the output of the voltage-to-frequency converter 43, is divided in a fixed ratio by a frequency divider 48, delivering pulses of frequency $f_p$ which trigger a monostable multivibrator 49. The DC component $J_g$ of the heating current may be adjusted by two Darlington transistors 50,51 whose collectors are connected to the positive battery volt $U_b$ while the emitter of the first transistor 50 is connected to the bridge circuit and the base is connected to the emitter of the second transistor 51. The base of the second transistor 51 is connected to the tap of a voltage divider 52,53 connected to a regulated voltage $U_{stab}$ and including a balancing resistor 52. Superimposed on the DC component $J_g$ is a current component $I_w$ whose magnitude changes periodically and which consists of a sequence of heating pulses whose frequency $f_p$ may be changed in dependence on the aspirated air quantity. These pulses are triggered by the monostable multivibrator 49 which controls the base of a transistor 54 whose collector is connected to the regulated voltage $U_{stab}$ and whose emitter is connected to the base of the transistor 51. Preferably, the heating pulses are of constant width.

Figure 2:
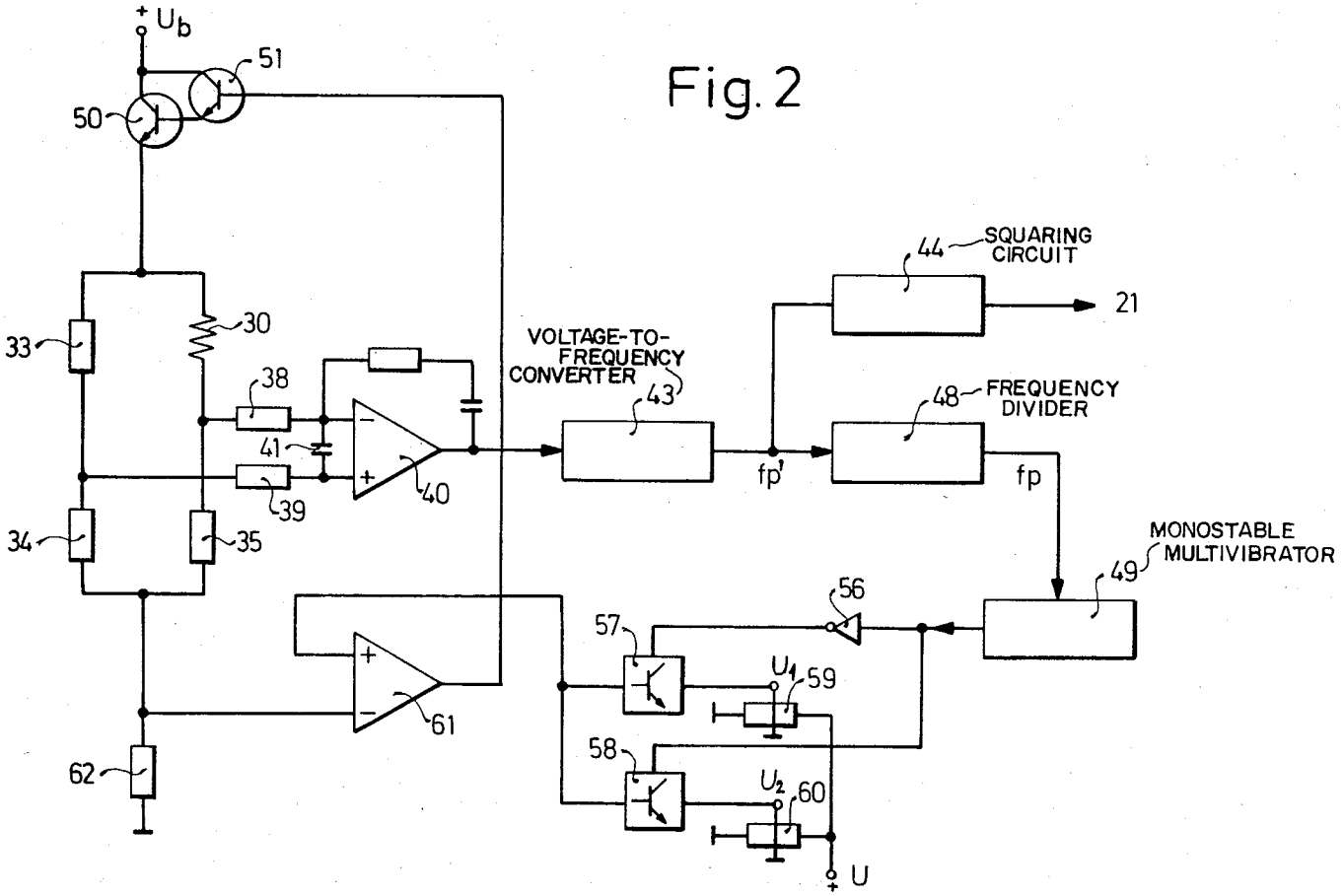
FIGS. 2–4 are schematic diagrams of three further exemplary embodiments of the electronic control system according to the invention, used in the fuel injection system shown in FIG. 1.

The second exemplary embodiment of the electronic control system 21 according to the invention is shown in FIG. 2 in which only those parts essential for the air quantity measurement are shown. The monostable multivibrator 49 is connected, firstly, to an inverter 56 which controls a first electronic switch 57 and, secondly, directly to a second electronic switch 58 so that, during the first state of the multivibrator 49, a voltage $U_1$ adjusted by a balancing resistor 59 is presented to the non-inverting input of an operational amplifier 61 whereas, during the second state of the multivibrator 49, a second voltage $U_2$ adjusted by a balancing resistor 60 is presented to the same positive input via the electronic switch 58. The inverting input of the operational amplifier 61 is connected to the junction of the bridge with a measuring resistor 62, in turn connected to ground. The output voltage from the operational amplifier 61 controls the transistor 51 of the Darlington circuit. Thus, according to this exemplary embodiment of the invention, the pulses of frequency $f_p$ alternately supply the bridge with one of two constant currents which are proportional to the voltages $U_1$ and $U_2$, respectively. This exemplary embodiment according to FIG. 2 advantageously compensates for the temperature-dependence of the base-emitter path of the Darlington circuit and permits the internal impedence of the source of regulated voltage $U_{stab}$ to be high, which facilitates balancing the circuit.

Figure 3:
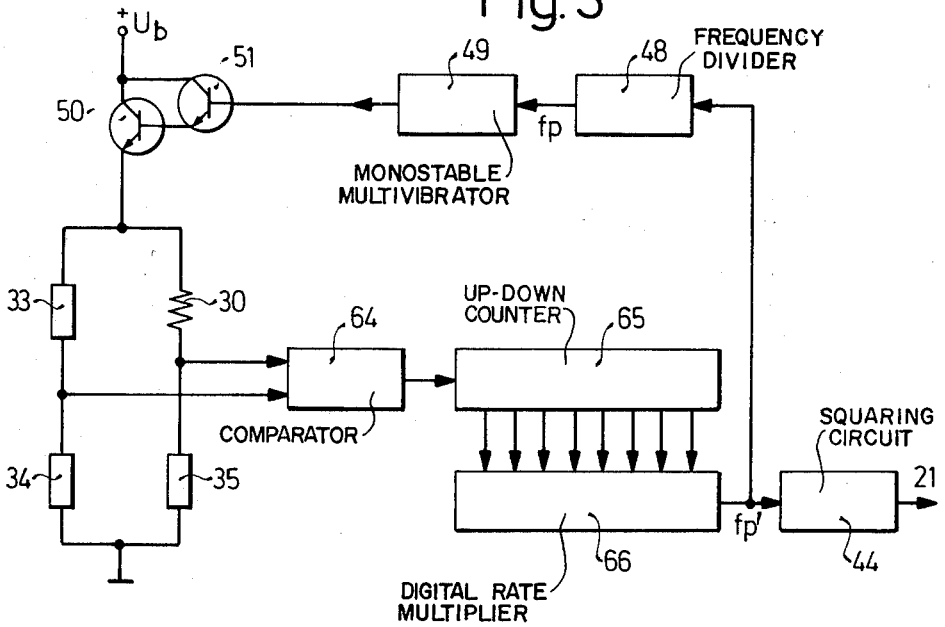

The third exemplary embodiment of the invention, shown in FIG. 3, includes a comparator 64, connected across the output diagonal of the bridge, which determines whether the average heating current, i.e. the corresponding pulse frequency, is to be increased or decreased. For this purpose, the algebraic sign input of an up-down counter 65 is connected to the output of the comparator 64. The counter 65 is triggered at a constant clock frequency and thus continuously changes its digital counter output in the direction dictated by the signal from the comparator. The output of the up-down counter 65 is connected to a digital rate multiplier 66 (for example SN 7497 of TI) whose output provides an average frequency $tp'$.

Figure 4:
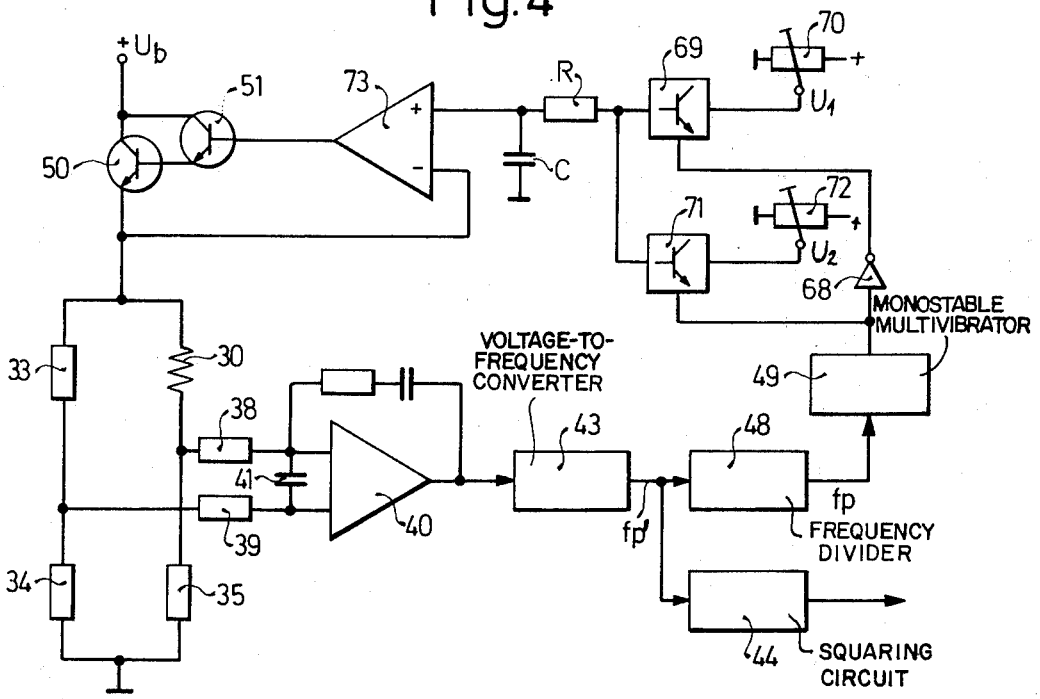

In the fourth exemplary embodiment of the invention, shown in FIG. 4, the heating current of the bridge circuit is an adjustable DC current consisting of an adjustable first DC component $J_{g1}$ serving for basic calibration and an adjustable second DC component $J_{g2}$ for compensating the heat loss of the temperature-dependent resistor to the air current. This compensation is achieved by placing at the input of an integrating RC-member either a first voltage $U_1$, adjusted by a balancing resistor 70 and passed through an inverter 68 and an electronic switch 69, during the first state of the multivibrator, or by placing there a second voltage $U_2$, adjusted by a balancing resistor 72, via an electronic switch 71, during the second state of the multivibrator. As a result, the output of the integrating RC-circuit exhibits an average DC potential which can be used to control the heating current of the bridge circuit via an operational amplifier 73.

We claim:

1. An electrically operated fuel injection system for an internal combustion engine, said engine having an induction tube and fuel injection valves, said system including:

A. an air flow rate sensor, having an electrically heated, temperature-dependent resistor, located in said induction tube and connected in an electrical bridge circuit which is part of a closed control loop;

B. a source of electric current;

C. means for apportioning said electric current to said resistor in two components, the first component being a DC component whose magnitude is finite when the air flow is zero, and the second component being a variable current whose magnitude vanishes together with the air flow and whose magnitude can increase with increasing air flow to thereby generate additional heat in said resistor to compensate for heat loss to the air flow;

D. an operational amplifier, whose inputs are connected to separate junction points in said bridge circuit and which provides an output voltage related to the difference of potential between said separate junction points;

E. voltage-to-frequency converter means, connected to receive said output voltage and providing a control signal whose frequency is proportional to the air flow rate;

F. electronic current control means for receiving said control signal and for providing said second heating current component for said resistor;

G. a squaring circuit, connected to receive said control signal and for spacing its frequency;

H. a digitally operating electronic fuel control unit, connected to receive said squared control signal and to provide a fuel control datum for determining the opening time of the fuel injection valves of the engine; and I. frequency dividing means, connected to receive said control signal and to thereby provide an output signal of a second, reduced frequency which is applied to said current control means.

2. A fuel injection system according to claim 1, wherein said second heating current component is a series of pulses delivered by said current control means at said second, reduced frequency.

3. A fuel injection system according to claim 2, wherein said pulses are of equal duration.

4. A fuel injection system according to claim 3, wherein said current control means includes two transistors in Darlington configuration, biased to provide said first current component.

5. A fuel injection system according to claim 4, further comprising:

J. a monostable multivibrator, triggered by said signal of second, reduced frequency and connected to the base of one of said two transistors to provide said second, variable current component.

6. A fuel injection system according to claim 5, wherein said current control means further includes a first source of electric potential and a second source of different potential, a monostable multivibrator, alternately activating said first and second sources of potential, and a second operational amplifier whose input receives said alternating first and second potential and delivers an output control voltage to one of said transistoes for providing said second variable current component.

7. An electrically operated fuel injection system for an internal combustion engine, said engine having an induction tube and fuel injection valves, said system including:

A. an air flow rate sensor, having an electrically heated, temperature-dependent resistor, located in said induction tube and connected in an electrical bridge circuit which is part of a closed control loop;

B. a source of electric current;

C. means for apportioning said electric current to said resistor in two components, the first component being a DC component whose magnitude is finite when the air flow is zero, and the second component being a variable current whose magnitude vanishes together with the air flow and whose magnitude can increase with increasing air flow to thereby generate additional heat in said resistor to compensate for heat loss to the air flow;

D. an operational amplifier, whose inputs are connected to separate junction points in said bridge circuit and which provides an output voltage related to the difference of potential between said separate junction points;

E. voltage-to-frequency converter means, connected to receive said output voltage and providing a control signal whose frequency is proportional to the air flow rate;

F. electronic current control means for receiving said control signal and for providing said second heating current component for said resistor;

G. a squaring circuit, connected to receive said control signal and for squaring its frequency; and H. a digitally operating electronic fuel control unit, connected to receive said squared control signal and to provide a fuel control datum for determining the opening time of the fuel injection valves of the engine.

8. An electrically operated fuel injection system for an internal combustion engine, said engine having an induction tube and fuel injection valves, said system including:

A. an air flow rate sensor, having an electrically heated, temperature-dependent resistor, located in said induction tube and connected in an electrical bridge circuit which is part of a closed control loop;

B. a source of electric current;

C. means for apportioning said electric current to said resistor in two components, the first component being a DC component whose magnitude is finite when the air flow is zero, and the second component being a variable current whose magnitude vanishes together with the air flow and whose magnitude can increase with increasing air flow to thereby generate additional heat in said resistor to compensate for heat loss to the air flow;

D. an operational amplifier, whose inputs are connected to separate junction points in said bridge circuit and which provides an output voltage related to the difference of potential between said separate junction points;

E. voltage-to-frequency converter means, connected to receive said output voltage and providing a control signal whose frequency is proportional to the air flow rate;

F. electronic current control means for receiving said control signal and for providing said second heating current component for said resistor;

G. a squaring circuit, connected to receive said control signal and for squaring its frequency; and H. A digitally operating electronic fuel control unit, connected to receive said squared control signal and to provide a fuel control datum for determining the opening time of the fuel injection valves of the engine, wherein:

i. said operational amplifier is connected as a comparator; and ii. said voltage-to-frequency converter means includes a digital up-down counter with a digital input, and a rate multiplier whose input in connected to receive said digital output.

9. An electrically operated fuel injection system for an internal combustion engine, said engine having an induction tube and fuel injection valves, said system including:

A. an air flow rate sensor, having an electrically heated, temperature-dependent resistor, located in said induction tube and connected in an electrical bridge circuit which is part of a closed control loop;

B. a source of electric current;

C. means for apportioning said electric current to said resistor in two components, the first component being a DC component whose magnitude is finite when the air flow is zero, and the second component being a variable current whose magnitude vanishes together with the air flow and whose magnitude can increase with increasing air flow to thereby generate additional heat in said resistor to compensate for heat loss to the air flow;

D. an operational amplifier, whose inputs are connected to separate junction points in said bridge circuit and which provides an output voltage related to the difference of potential between said separate junction points;

E. voltage-to-frequency converter means, connected to receive said output voltage and providing a control signal whose frequency is proportional to the air flow rate;

F. electronic current control means for receiving said control signal and for providing said second heating current component for said resistor;

G. a squaring circuit, connected to receive said control signal and for squaring its frequency;

H. a digitally operating electronic fuel control unit, connected to receive said squared control signal and to provide an fuel control datum for determining the opening time of the fuel injection valves of the engine; and I. frequency dividing means, connected to receive said control signal and providing an output signal of a second, reduced frequency which is applied to said current control means to thereby provide a series of heating pulses at said second reduced frequency, and wherein said current control means includes:

i. a first source of electric potential;

ii. a second source of different electric potential;

iii. a monostable multivibrator, alternately activating said first and second sources of potential; and iv. integrating means, receiving said first and second electric potentials for generation of said first and second heating current components.

* * * * *